US011583098B2

(12) United States Patent
Albæk et al.

(10) Patent No.: US 11,583,098 B2
(45) Date of Patent: Feb. 21, 2023

(54) POCKET SPRING CORE

(71) Applicant: L&P Swiss Holding GmbH, Wittenbach (CH)

(72) Inventors: Niels Albæk, Varde (DK); Morten Jørgensen, Gram (DK)

(73) Assignee: L&P Swiss Holding GmbH, Wittenbach (CH)

( * ) Notice: Subject to any disclaimer, the term of this patent is extended or adjusted under 35 U.S.C. 154(b) by 0 days.

(21) Appl. No.: 17/296,833

(22) PCT Filed: Nov. 20, 2019

(86) PCT No.: PCT/EP2019/081974

§ 371 (c)(1),
(2) Date: May 25, 2021

(87) PCT Pub. No.: WO2020/109112

PCT Pub. Date: Jun. 4, 2020

(65) Prior Publication Data

US 2022/0000272 A1 Jan. 6, 2022

(30) Foreign Application Priority Data

Nov. 26, 2018 (EP) ..... 18208308

(51) Int. Cl.
*A47C 27/06* (2006.01)
*A47C 27/07* (2006.01)

(52) U.S. Cl.
CPC ..... *A47C 27/064* (2013.01); *A47C 27/07* (2013.01)

(58) Field of Classification Search
CPC ..... A47C 27/07; A47C 27/064; A47C 27/063; Y10T 29/481
See application file for complete search history.

(56) References Cited

U.S. PATENT DOCUMENTS 2,715,435 A * 8/1955 Rymland ..... A47C 27/062 267/93
2,862,214 A * 12/1958 Thompson ..... A47C 27/064 5/720

(Continued)

FOREIGN PATENT DOCUMENTS

CN 1328307 C * 7/2007 ..... B32B 15/18
DE 19621361 A1 12/1997

(Continued)

OTHER PUBLICATIONS

FR-2697420-A1 translation (Year: 1994).*

(Continued)

*Primary Examiner* — Michael W Hotchkiss

(74) *Attorney, Agent, or Firm* — Wood Herron & Evans LLP

(57) ABSTRACT

The present invention relates to a pocket spring core (40). The pocket spring core (40) comprises a plurality of pocketed spring elements (41). Each of the plurality of pocketed spring elements (41) is formed of a pocket (42) and at least one coil spring (43) enclosed by the pocket (42). The pocket spring core (40) comprises furthermore a frame element (44) enclosing an arrangement of the plurality of pocketed spring elements (41) along a circumference of the arrangement. The frame element (44) is glued to several pockets (42) of the plurality of pocketed spring elements (41) using a hot melt adhesive, a polyurethane adhesive or an epoxy lime adhesive.

16 Claims, 8 Drawing Sheets

(56) References Cited

U.S. PATENT DOCUMENTS

| | | | | | |
|---|---|---|---|---|---|
| 4,578,834 | A * | 4/1986 | Stumpf | A47C 27/064 | 156/291 |
| 5,127,635 | A * | 7/1992 | Long | A47C 27/063 | 267/91 |
| 6,131,892 | A * | 10/2000 | Stumpf | A47C 27/064 | 267/89 |
| 6,398,199 | B1 * | 6/2002 | Barber | A47C 27/064 | 5/655.8 |
| 6,490,744 | B1 * | 12/2002 | Schulz, Jr. | A47C 27/063 | 5/716 |
| 6,829,798 | B2 * | 12/2004 | Wells | A47C 27/064 | 5/721 |
| 6,952,850 | B2 * | 10/2005 | Visser | A47C 27/056 | 5/690 |
| 8,561,236 | B2 * | 10/2013 | Witherell | A47C 27/056 | 5/717 |
| 8,671,483 | B2 * | 3/2014 | Bullard | A47C 27/066 | 5/654.1 |
| 9,179,782 | B2 * | 11/2015 | Schiller | A47C 27/056 | |
| 9,504,332 | B2 * | 11/2016 | Gladney | A47C 27/05 | |
| 10,104,970 | B1 * | 10/2018 | Stiles | A47C 7/34 | |
| 10,165,867 | B2 * | 1/2019 | Mossbeck | A47C 27/066 | |
| 2002/0029424 | A1 * | 3/2002 | Balsavich | A47C 23/30 | 5/720 |
| 2003/0121103 | A1 * | 7/2003 | Wempe | A47C 7/029 | 5/654 |
| 2005/0132497 | A1 * | 6/2005 | Schmidt | A47C 27/06 | 5/716 |
| 2005/0251920 | A1 * | 11/2005 | Ahn | A47C 27/063 | 5/716 |
| 2005/0278862 | A1 * | 12/2005 | Kuchel | A47C 27/056 | 5/248 |
| 2007/0129522 | A1 * | 6/2007 | Burckhardt | C09J 175/04 | 528/44 |
| 2007/0204407 | A1 * | 9/2007 | Lee | A47C 27/05 | 5/720 |
| 2008/0109965 | A1 * | 5/2008 | Mossbeck | A47C 27/061 | 5/713 |
| 2011/0171762 | A1 * | 7/2011 | West | H01L 33/44 | 438/27 |
| 2011/0191962 | A1 * | 8/2011 | Frame | A47C 27/064 | 5/717 |
| 2011/0197367 | A1 * | 8/2011 | Mossbeck | A47C 27/064 | 5/655.8 |
| 2013/0174344 | A1 * | 7/2013 | Klancnik | A47C 27/064 | 5/636 |
| 2013/0174350 | A1 * | 7/2013 | Allman | A47C 27/144 | 5/740 |
| 2016/0066702 | A1 * | 3/2016 | DiMarco | A47C 27/15 | 156/64 |
| 2017/0290438 | A1 * | 10/2017 | Navarra | A47C 27/064 | |
| 2018/0368583 | A1 * | 12/2018 | Mantzis | A47C 27/064 | |

FOREIGN PATENT DOCUMENTS

| | | | | |
|---|---|---|---|---|
| EP | 2653070 | B1 * | 3/2018 | A47C 27/064 |
| FR | 2697420 | A1 * | 5/1994 | A47C 27/064 |
| JP | H09276084 | A * | 10/1997 | A47C 27/06 |
| JP | 2012095785 | A | 5/2012 | |
| WO | 9635355 | A1 | 11/1996 | |
| WO | WO1996035355 | A1 * | 11/1996 | A47C 27/064 |

OTHER PUBLICATIONS

CN-1328307-C translation (Year: 2007).*
EP-2653070-B1 translation (Year: 2018).*
JPH09276084A Machine Translation (Year: 1997).*
JPH09276084A Abstract Machine Translation (Year: 1997).*
European Patent Office; Search Report and Written Opinion in related International Patent Application No. PCT/EP2019/081974 dated Dec. 10, 2019; 11 pages.

* cited by examiner

POCKET SPRING CORE

FIELD OF THE INVENTION

The invention relates to a pocket spring core, a bedding or seating product comprising a pocket spring core, and a method of manufacturing a pocket spring core.

BACKGROUND OF THE INVENTION

Pocket spring cores are widely used in seating and bedding products. Pocket spring cores may be made of a matrix of multiple pocketed springs joined together by a fabric within which each an individual spring is contained. Additionally, the matrix of multiple pocketed springs may be enclosed by a frame extending along a circumference of the matrix of the multiple pocketed springs. The frame may be positioned at a center height of the pocketed springs and may be fastened by clips, which attach the frame to a pocketed spring turn located closest to the center height of the pocketed spring.

FIG. 1 shows a prior art pocket spring core 20 comprising an arrangement of a plurality of pocketed spring elements 21. Each pocketed spring element 21 comprises a pocket 23 which contains a coil spring 24. The arrangement of the plurality of pocketed spring elements 21 is enclosed by a frame 22. The frame 22 is coupled to at least some of the plurality of pocketed spring elements 21. In particular, the frame 22 is coupled via a clip 26 to a turn 25 of a coil spring 24 enclosed by a corresponding pocket 23.

FIG. 2 shows the coupling of the frame 22 to the turn 25 of the coil spring 24 via the clip 26 in more detail. For coupling the frame 22 with the clip 26 to the coil spring 24 when attaching the clip 26, the clip 26 penetrates the nonwoven material of the pocket 23. In FIGS. 1 and 2, the frame 22 is coupled to the pocketed spring elements 21 in a central region of the height of the pocketed spring elements 21. Additionally or as an alternative, as shown in FIG. 3, a frame 31 may be coupled to the coil springs 24 of the pocketed spring elements 21 at a top region of the pocketed spring elements 21 with corresponding clips 26, and further optionally, a further frame 32 may be coupled to the coil springs 24 of the pocketed spring elements 21 at a bottom region of the pocketed spring elements 21 with corresponding clips 26.

Coupling the frame 22, 31, 32 to the coil springs 24 with clips 26 is a manual or semiautomatic task as the positioning of the frame 22, 31, 32 has to be aligned for each pocket spring element 21 to ensure correct clipping to an appropriate position at the spring turn 25.

Therefore, there is a need for an efficient coupling of the frame to the pocket spring elements.

BRIEF SUMMARY OF THE INVENTION

According to the present invention, a pocket spring core and a method of manufacturing a pocket spring core as defined in the independent claims are provided. The dependent claims define preferred and/or advantageous embodiments of the invention.

According to an embodiment, a pocket spring core is provided, for example for incorporation into a bedding product, such as a mattress, or for incorporation into a seating product, such as a sofa cushion or chair cushion. The pocket spring core comprises a plurality of pocketed spring elements. Each pocketed spring element of the plurality of pocketed spring elements is formed of a pocket and at least one coil spring which is enclosed by the pocket. Some or each pockets may comprise more than one coil spring, for example for adjusting a firmness or rigidity of a mattress or some areas thereof. The coil springs may be formed of a metal wire, for example steel wire. The pocket spring core comprises furthermore a frame element for enclosing an arrangement of at least a subset of the plurality of pocketed spring elements. The frame element may have a rectangular form. For example, the plurality of pocketed spring elements may be arranged in a matrix and the frame element encloses the matrix along a circumference of this arrangement. The frame element may enclose all pocketed spring elements of the pocket spring core, or the frame element may enclose only some pocketed spring elements of the pocket spring core whereas some other pocketed spring elements of the pocket spring core are arrange outside the frame element. For example, one, two or three rows of pocketed spring elements may be arranged outside the frame element and the remaining pocketed spring elements may be arranged within the frame element. The frame element may be formed of metal, for example steel, or plastics or a combination of metal and plastics. The frame element is glued to several pockets of the plurality of pocketed spring elements. For example, the frame element may be glued to those several pockets of the plurality of pocketed spring elements which are arranged along the circumference of the arrangement of the plurality of pocketed spring elements. In particular, the frame element may be directly glued to the several pockets of the plurality of pocketed spring elements, which means that, apart from the glue, there may be no further components between the frame element and the several pockets. By gluing the frame element to the pockets, the locations of the turns of the coil springs must not be considered and no fastening materials, for example clips, are required, such that gluing the frame element to the pockets may be automated and may be performed by a machine or robot. As a result, manufacturing cost may be reduced. Furthermore, the frame element may be attached to the pocketed spring elements at an arbitrary height of a side of the pocketed spring elements as the frame element can be attached to the pocketed spring elements without considering the position of the turns of the coil springs inside the pockets. The frame element is glued to the several pockets using a hot melt adhesive, polyurethane (PU) adhesive or epoxy lime adhesive. However, other adhesives may additionally be used, for example non-reactive or reactive adhesives.

For example, the hot melt adhesive may be based on polymer components including polyolefins such as ethylene-vinyl acetate copolymer (EVA), linear low density polyethylene (LLDPE) and other ethylene based semi-crystalline polymers, such as amorphous poly-alpha-olefins (APAO), such as olefin block copolymer (OBC), such as amorphous polypropylene, isotactic polypropylene and other propylene based polymers, styrene block copolymers (SBC) such as styrene-isoprene-styrene (SIS) copolymer and styrene-butadiene-styrene (SBS) copolymer, ethylene ethyl acrylate copolymers (EEA), polyamides (PA), polyesters, and polyurethane reactive adhesives (PUR).

According to further examples, the polyurethane adhesive may comprise for example a PU adhesion based on isocyanate and polyolen or polyol.

In further examples, the epoxy lime adhesive may comprise for example two-component epoxy glue.

Such glue or adhesive may have properties which meet requirements of durability tests according to EN1957 without breakage of the glue connections between the frame element and the several pockets, for example between a steel frame and a pocket of nonwoven/woven material. In particular, such glue or adhesive may enable to roll pack for example a mattress comprising the pocket spring core with single or double frame elements glued to the pockets in rolls with a max. diameter of 60-70 cm, preferably 62-63 cm, including 7 to 15 pocketed spring elements in line along the rolling direction, without breakage of the glue connections between the frame element and the pockets either during or after opening the roll in a controlled opener. Furthermore, such glue or adhesive may allow the roll packed pocket spring core to be exposed during storage to low temperatures far below 0° C. not causing the glue connections between the frame element and pocket to break when opening the roll packed pocket spring core later.

According to various examples, each pocket of the several pockets has a cylindrical shape. The frame element may be glued to a center region of a side of each pocket of the several pockets. As an alternative, the frame element may be glued to a top region of a side of each pocket of the several pockets. Furthermore, a further frame element enclosing the arrangement of the plurality of pocketed spring elements along a circumference of the arrangement may be glued to a bottom region of the side of each pocket of the several pockets. Thus, depending on requirements concerning rigidity and stability, the number and position of frame elements may be easily varied without significantly changing the automated manufacturing process.

According to further examples, each pocket of the several pockets is made by spunbonding. Additionally or as an alternative, each pocket of the several pockets may be made by needlepunching woven material or other nonwoven material. Such pockets may provide a reliable enclosing for the coil springs and may be reliably glued to the frame element.

According to various examples, the frame element may comprise a plurality of straight sections coupled to each other, so that each of the plurality of straight sections extends along a respective side of the arrangement of the plurality of pocketed spring elements. For example, for a mattress, the pocketed spring elements may be arranged in a rectangular matrix and the frame element may comprise four straight sections extending along the circumferential sides of the rectangular matrix. A cross-section of the straight sections of the frame element may be round, square or rectangular.

The frame element may be made of a metal or plastic profile or a combination of metal and plastic with a solid or hollow cross-section. The cross section may be a quadratic cross section, a rectangular cross section, a triangular cross section, a trapezium cross section, a polygonal cross section, a circular cross section, an ellipse/oval cross section, or combinations of the above cross sections. The type of cross-section in combination with a corresponding dimensioning of the cross section may support stability of the frame element and roll packaging of the mattress.

The pocket spring core may further comprise a cover sheet arranged along the frame element having a width larger than a width of the frame element. The cover sheet may contribute to avoid that glue residues outside the frame attach to other components when stacking several pocket spring core units or roll packaging the pocket spring core.

The pocket spring core may further comprising a sheet layer arranged between the frame element and at least some of the plurality of pocketed spring elements. One surface of the sheet layer is glued to the at least some of the plurality of pocketed spring elements and another surface of the sheet layer opposing the one surface of the sheet layer is glued to the frame element. Thus, a force from the frame element, for example when roll packaging the pocket spring core or twisting the pocket spring core, may be distributed over the at least some of the plurality of pocketed spring elements.

According to a further embodiment, a bedding or seating product is provided. The bedding or seating product comprises a pocket spring core as defined above. The pocket spring core may comprise, for example, a plurality of pocketed spring elements and a frame element. Each of the plurality of pocketed spring elements is formed of a pocket and at least one coil spring enclosed by the pocket. The frame element encloses an arrangement of the plurality of pocketed spring elements along a circumference of the arrangement. The frame element is glued to several pockets of the plurality of pocketed spring elements.

According to another embodiment, a method of manufacturing a pocket spring core is provided. According to the method, an arrangement of a plurality of pocketed spring elements is provided. Each of the plurality of pocketed spring elements is formed of a pocket and at least one coil spring enclosed by the pocket. A frame element is positioned such that the frame element encloses the arrangement of the plurality of pocketed spring elements along the circumference of the arrangement. Furthermore, the frame element is positioned such that it is in contact with several pockets of the arrangement of the plurality of pocketed spring elements. Further, according to the method, the frame element is glued to the several pockets of the plurality of pocketed spring elements using an adhesive selected from a group comprising a hot melt adhesive, a polyurethane adhesive, and an epoxy lime adhesive. By gluing the frame element to the several pockets, additional fastening elements, for example clips, are not required. This may reduce production cost and complexity of the manufacturing process.

The pocket spring core may comprise the pocket spring core defined in the embodiments above.

According to various examples, at least the steps of positioning and gluing of the frame element may be performed automatically by a manufacturing machine, for example by a robot. This may contribute to further reducing production cost.

Although in the above summary various embodiments and examples are described separately, the various embodiments and examples may be combined with each other unless specifically noted otherwise.

BRIEF DESCRIPTION OF THE DRAWINGS

Embodiments of the invention will be described with reference to the accompanying drawings.

DETAILED DESCRIPTION OF EMBODIMENTS

Figure 1:
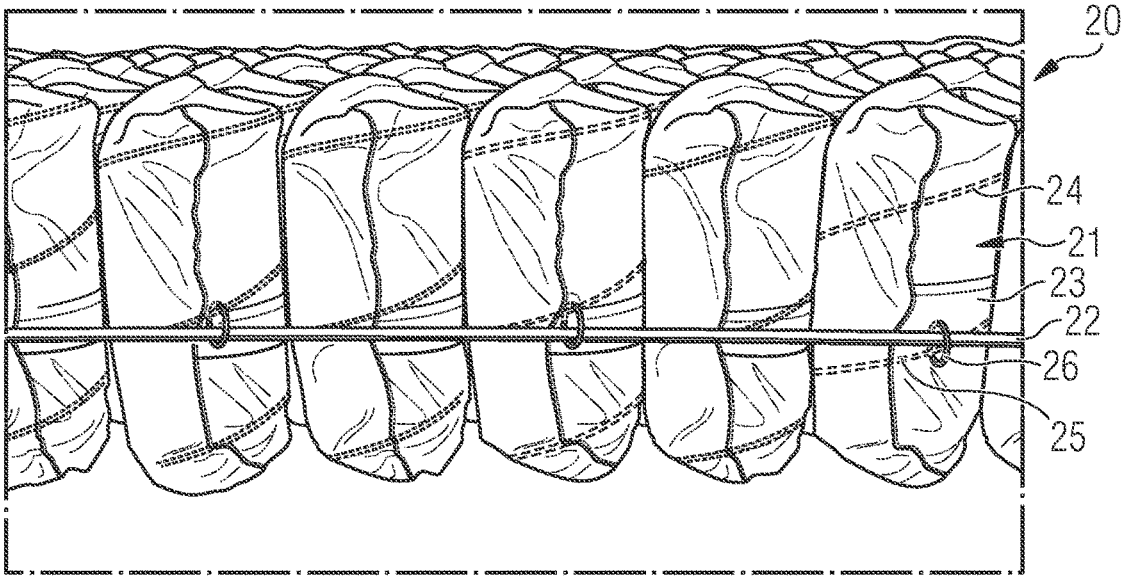
FIG. 1 shows a schematic perspective view of a prior art pocket spring core.
Figure 2:
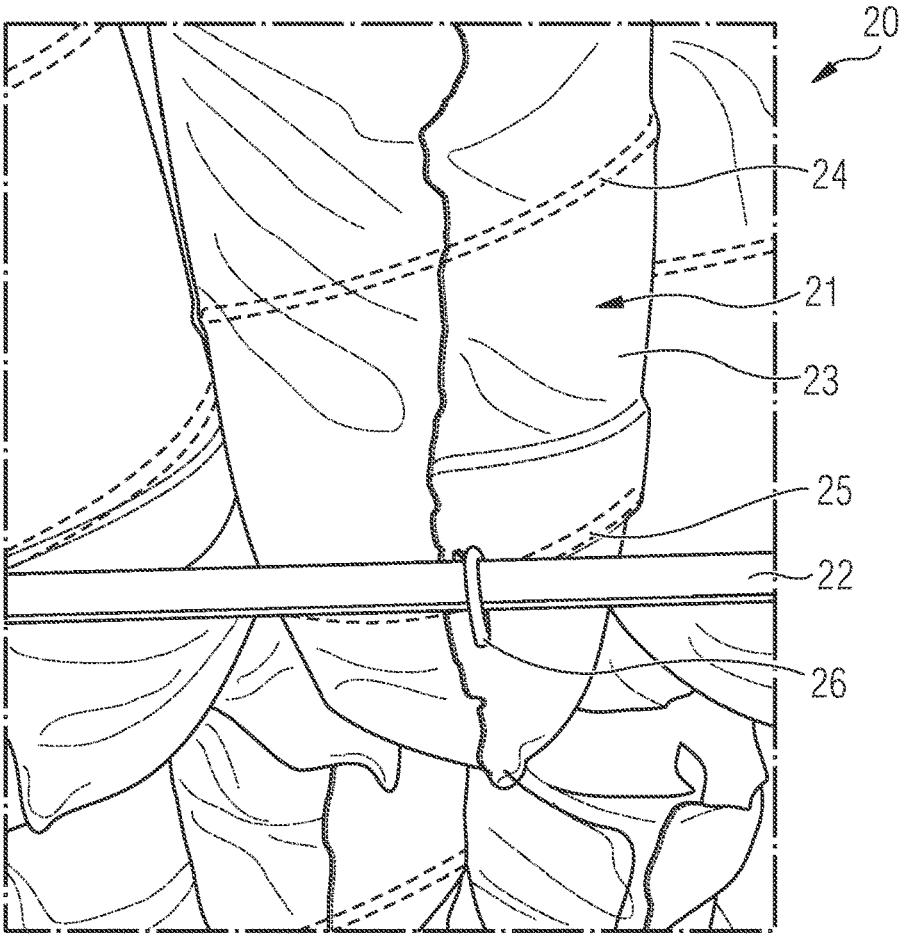
FIG. 2 shows schematically an attachment of a frame element to a pocketed spring element using a clip.
Figure 3:
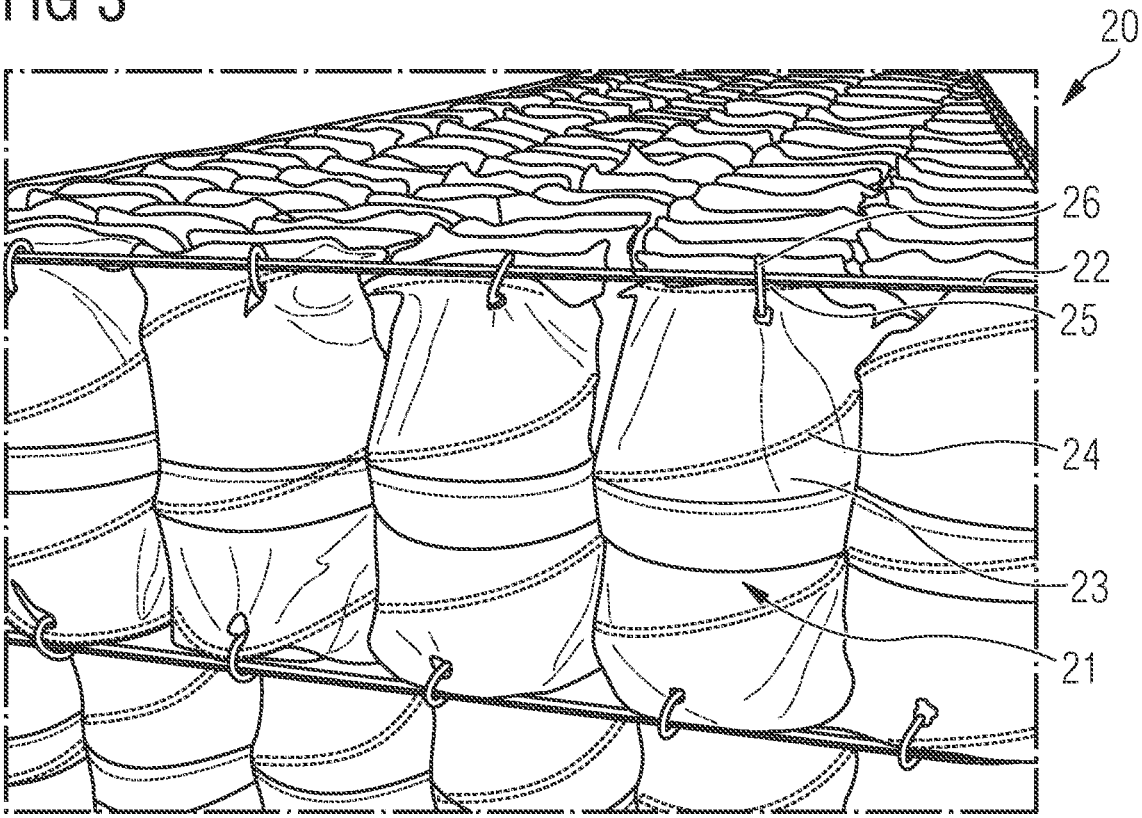
FIG. 3 shows a schematic perspective view of a further prior art pocket spring core.

Exemplary embodiments of the invention will be described with reference to the drawings. While some embodiments will be described in the context of specific fields of application, such as in the context of mattresses, the embodiments are not limited to this field of application. The features of the various embodiments described in the following description may be combined with each other unless specifically noted otherwise. Throughout the following description, same or like reference numerals refer to same or like components or mechanisms.

Figure 4:
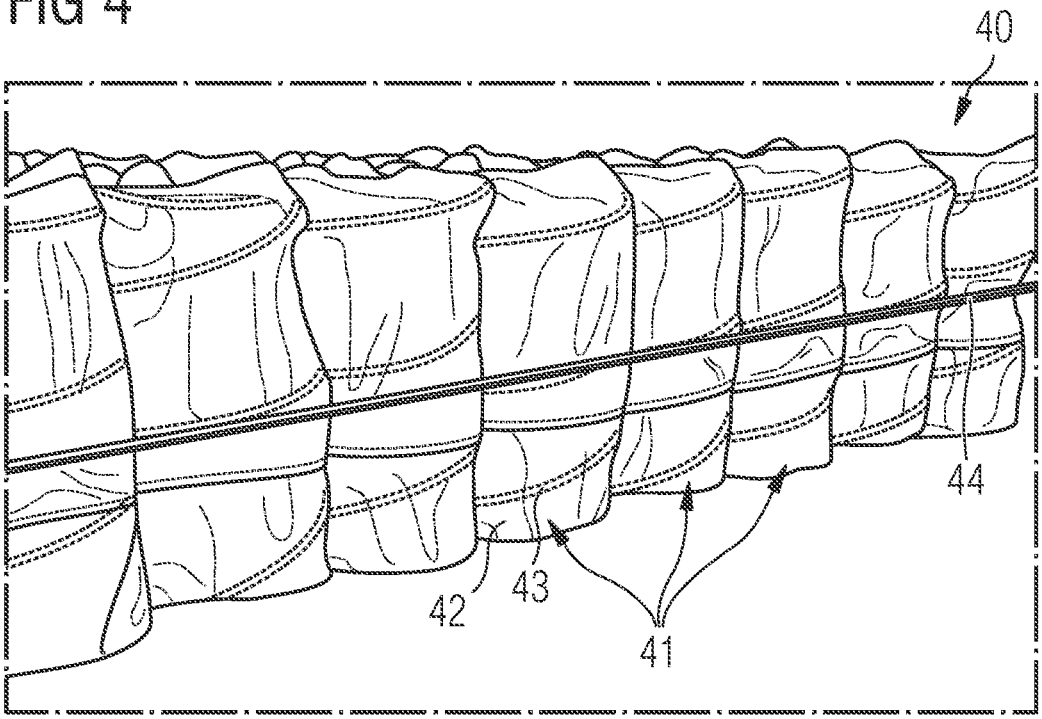
FIG. 4 shows a schematic perspective view of a pocket spring core according to an embodiment.

FIG. 4 shows a perspective side view of a pocket spring core 40 according to an embodiment. The pocket spring core 40 comprises a plurality of pocketed spring elements 41, which are arranged in a matrix, for example a rectangular matrix having a plurality of rows of pocketed spring elements 41. The matrix of pocketed spring elements may be intended to be comprised in a product, for example a mattress. The mattress may comprise further components, for example a foam pad (not shown) on top of the pocket spring core 40 and an upholstered covering material (not shown) enclosing the pocket spring core 40.

Each pocketed spring element 41 comprises a pocket 42 and at least one coil spring 43 enclosed by the pocket 42. The pocket 42 may be made by spunbonding or needlepunching woven material or other nonwoven material. Each pocketed spring element 41 may be formed by providing a fabric layer, inserting the coil spring 43 into the fabric layer, folding the fabric layer so as to cover the coil spring 43 either before or after insertion of the coil spring 43, and applying longitudinal and transverse seams, for example by welding. Thus, each pocketed spring element may have a cylindrical or barrel shape. A number of pocketed spring elements 41 may be arranged in a row which may extend along a length of the product, for example the mattress. A symmetry axis of the cylindrical or barrel shape extends in an up/down direction such that the sides of the pocketed spring elements 41 are in contact. Several of such rows may be arranged in a side-by-side relationship to create an arrangement or matrix of pocketed spring elements 41.

A frame element 44 is provided which encloses the arrangement of the plurality of pocketed spring elements 41 along a circumference of the arrangement. For example, the frame element 44 may have a rectangular form enclosing the arrangement of the plurality of pocketed spring elements 41. The frame element 44 may comprise four straight sections coupled at the corners of the pocket spring core 40 to each other and each of the four straight sections may extend along a respective side of the arrangement of the plurality of pocketed spring elements 41 of the pocket spring core 40. Thus, straight sections coupled to each other extend perpendicular to each other. The frame element 44 may have a round, square, triangular, trapezium, polygonal, circular, ellipse, oval or rectangular cross-section, or a combination of several of these cross sections. The frame element 44 may be made of steel or plastics. The frame element 44 may contact those pocketed spring elements 41 that are arranged at the circumference of the pocket spring core 40. At the contact points between the frame element 44 and the corresponding pocketed spring elements 41, the frame element 44 may be glued to the pocket material of the pocket 42.

Figure 5:
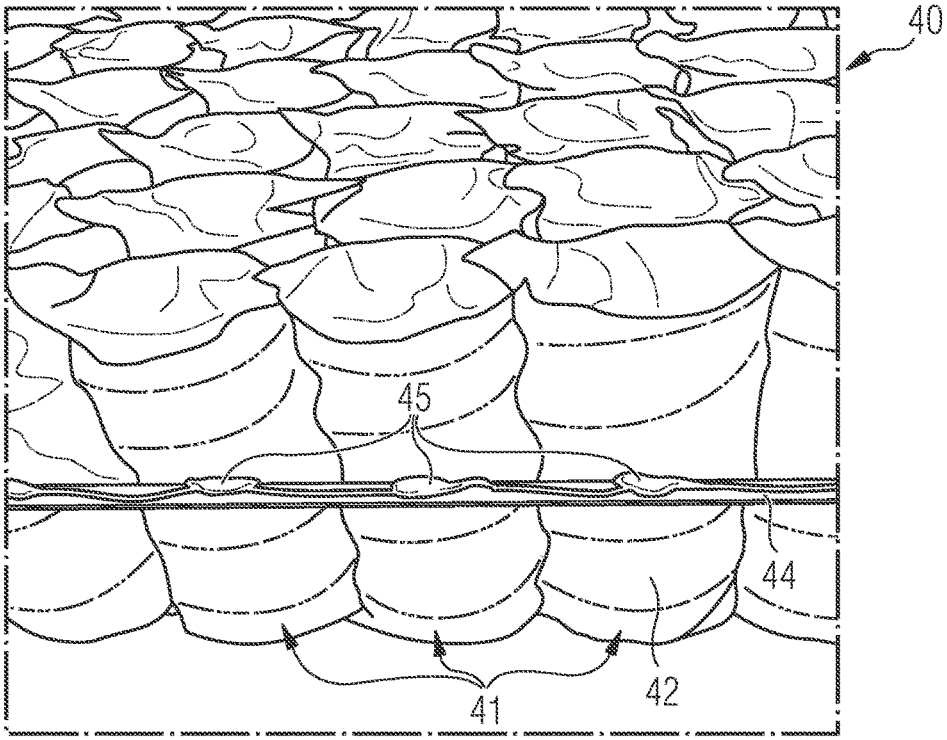
FIGS. 5-9 show schematic perspective views of a pocket spring core according to further embodiments.

FIG. 5 shows some of the pocketed spring elements 41 arranged at the circumference of the pocket spring core 40 which are in contact with the frame element 44. At contact points 45, the frame element 44 is glued to the pocket material of the pocketed spring elements 41. The adhesive used for gluing the frame element 44 to the pocket material of the pocketed spring elements 41 at the contact points 45 may comprise a hot melt adhesive, polyurethane (PU) adhesive or epoxy lime adhesive. However, other adhesives may additionally be used, for example non-reactive or reactive adhesives. The hot melt adhesive may be based on polymer components including polyolefins such as ethylene-vinyl acetate copolymer (EVA), linear low density polyethylene (LLDPE) and other ethylene based semi-crystalline polymers, such as amorphous poly-alpha-olefins (APAO), such as olefin block copolymer (OBC), such as amorphous polypropylene, isotactic polypropylene and other propylene based polymers, styrene block copolymers (SBC) such as styrene-isoprene-styrene (SIS) copolymer and styrene-butadiene-styrene (SBS) copolymer, ethylene ethyl acrylate copolymers (EEA), polyamides (PA), polyesters, and polyurethane reactive adhesives (PUR). The polyurethane adhesive may comprise for example a PU adhesion based on isocyanate and polyolen, and the epoxy lime adhesive may comprise for example two-component epoxy glue.

As further shown in FIG. 5, the frame element 44 is glued to the pockets at a center region of the side of the cylindrical or barrel shape of the pocketed spring elements 41. It is to be noticed that, due to gluing the frame element 44 to the pockets 42 of the pocketed spring elements 41, the frame element 44 may be arranged at an arbitrary height of the side of the cylindrical or barrel shape of the pocketed spring elements 41. As shown in FIG. 5, the frame element 44 may be glued to the pocketed spring elements 41 in a center region of the side of each pocket 42.

Figure 6:
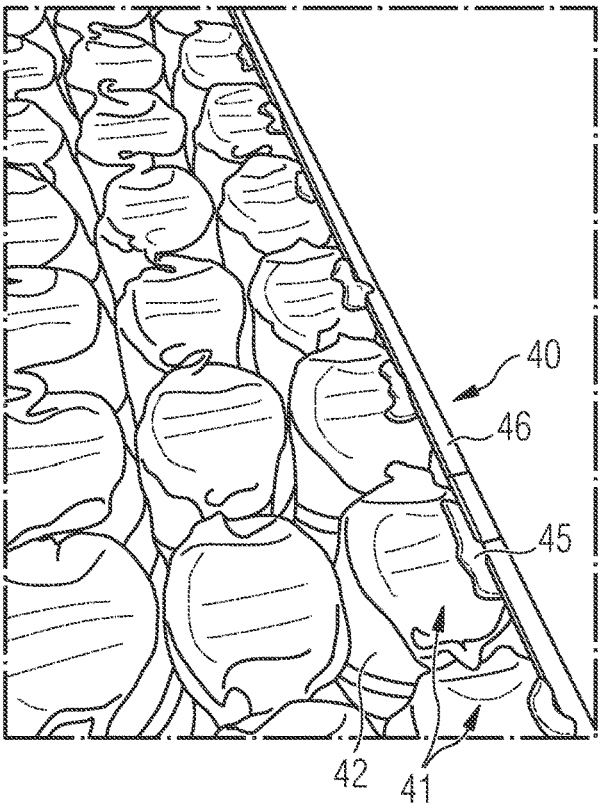
Figure 7:
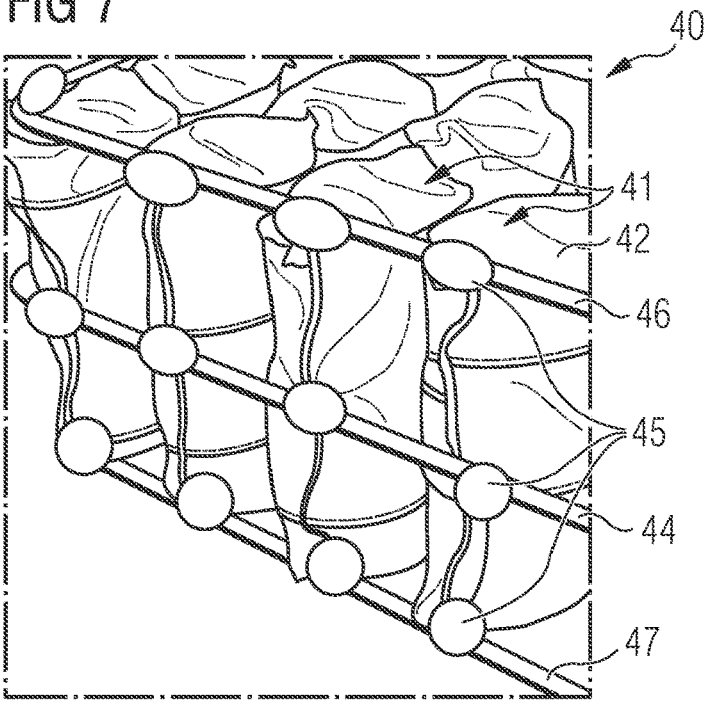

Additionally or as an alternative, as shown in FIG. 6, a frame element 46 may be glued at contact points 45 to the pocketed spring elements 41 in a top region of the side of each pocket 42. Furthermore, as shown in FIG. 7, a further frame element 47 may be glued at contact points 45 to the pocketed spring elements 41 in a bottom region of the side of each pocket 42.

To sum up, the frame element 44, 46, 47 may be positioned at an arbitrary height, for example at the middle, the top region or the lower region of the pocketed spring elements 41 without taking into account the locations of spring turns of the coil springs 43 inside the pocketed spring elements 41. Any other heights and number of frame elements may be selected as required or appropriate. Therefore, this process can be automated and is suitable to be performed by a machine, for example a robot.

Figure 8:
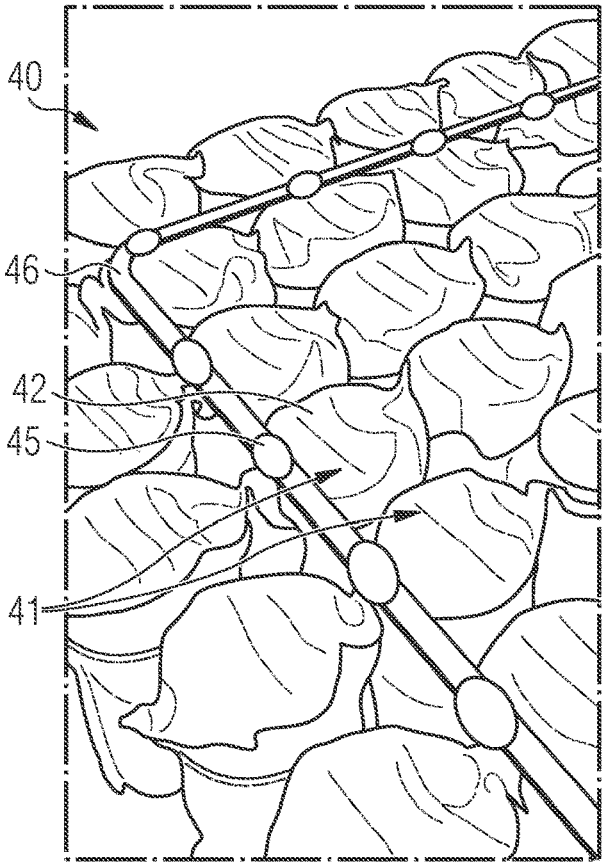
Figure 9:
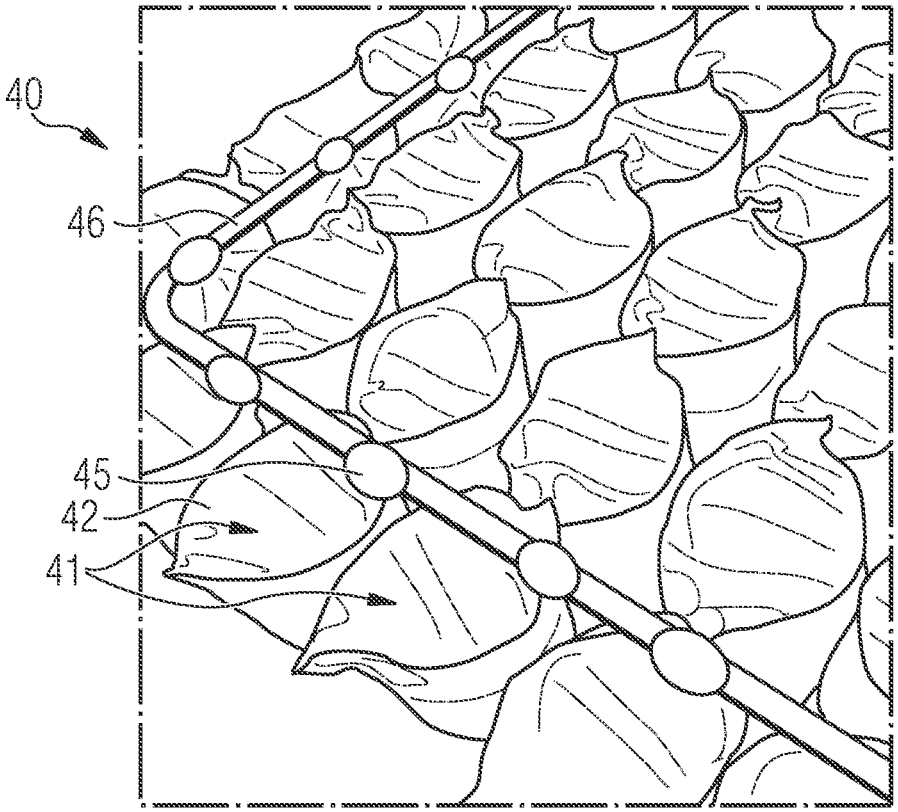

The frame element 44, 46, 47 may enclose only a subset of the pocketed spring elements 41 such that at least some of the pocketed spring elements 41 of the pocket spring core 40 are arranged outside the frame element 44, 46, 47 and the remaining pocketed spring elements 41 of the pocket spring call 40 are arranged inside and enclosed by the frame element 44, 46, 47. For example, in each direction in which the frame element 44, 46, 47 extends, a single row of pocketed spring elements 41 may be arranged outside the frame element 44, 46, 47, whereas the remaining pocketed spring elements 41 are arranged inside the frame element 44, 46, 47. FIGS. 8 and 9 show a corresponding arrangement of the frame element 46 enclosing all pocketed spring elements 41 of the pocket spring core 40 apart from those pocketed spring elements 41 which are arranged in the outermost positions of the pocketed spring core 40. As can be seen, the frame element 46 is smaller than an outer circumference of the pocket spring core 40. Although not shown in the figures, more than a single row of pocketed spring elements 41 may be arranged outside the frame element 44, 46, 47 in each direction in which the frame element 44, 46, 47 extends, for example two or three rows starting at and including the perimeter row of the pocket spring core 40.

As shown in FIG. 8, the frame element 46 may be glued at contact points 45 to the pockets 42 of those pocketed spring elements 41 which are enclosed by the frame element 46. As shown in FIG. 9, the frame element 46 may be glued at contact points 45 to the pockets 42 of those pocketed spring elements 41 which are not enclosed by the frame element 46. These two options may be selected as alternatives or in combination. In any case, the frame element 46 may be arranged in an arbitrary height of the side of the cylindrical or barrel shape of the pocketed spring elements 41, for example in a top region as shown in FIGS. 8 and 9, in a center region or a bottom region. As described above, a plurality of frame elements 44, 46, 47 may be arranged in different arbitrary heights of the side of the cylindrical or barrel shape of the pocketed spring elements, for example any arrangement comprising at least one of the frame element 46 at the top region, the frame element 47 at the bottom region, and the frame element 44 at the center region.

To improve adhesion to the frame element, for example a steel frame element, and to achieve a consistent adhesion force, the frame element may be preheated prior to the gluing so that the frame element is heated during storage before gluing the frame element to the pockets 42.

Preheating the frame element may be combined with a chemical/mechanical treatment of a surface of the frame element prior to preheating. For example, surface treatments may comprise brushing the surface of the frame element or punching holes in the frame element, or chemically cleaning or etching the surface of the frame element. However, the chemical/mechanical treatment of the surface of the frame element may be made independent from preheating the frame element, for example without preheating the frame element.

Figure 10:
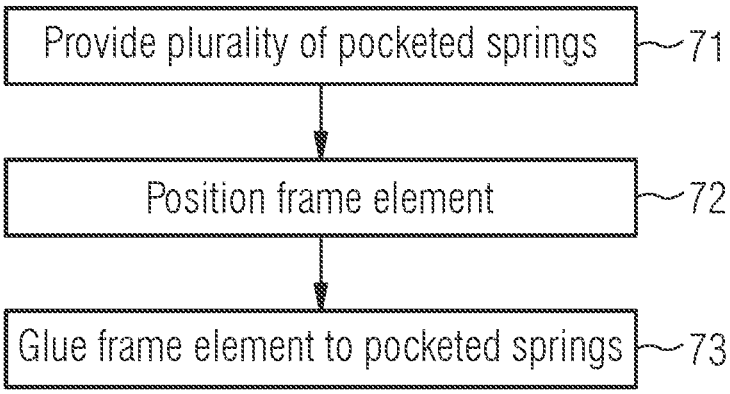
FIG. 10 shows a flowchart illustrating a spring core manufacturing according to an embodiment.

FIG. 10 shows method steps of a method for manufacturing a pocket spring core, for example the pocket spring core 40 shown in FIGS. 4 to 6. According to this method, an arrangement of a plurality of pocketed spring elements 41 is provided in step 71. Each of the plurality of pocketed spring elements 41 is formed of a pocket 42 and at least one coil spring 43 enclosed by the pocket 42. In step 72, a frame element 44 is positioned such that the frame element 44 encloses the arrangement of the plurality of pocketed spring elements 41 along a circumference of the arrangement. The frame element 44 is in contact with several pockets 42 of the arrangement of the plurality of pocketed spring elements 41. In step 73, the frame element 44 is glued to the several pockets 42 of the plurality of pocketed spring elements 41 to which the frame element 44 is in contact. At least the steps of positioning and gluing the frame element 44 to the pockets 42 of the plurality of pocketed spring elements 41 may be performed automatically by a manufacturing machine, such as a robot.

Figure 11:
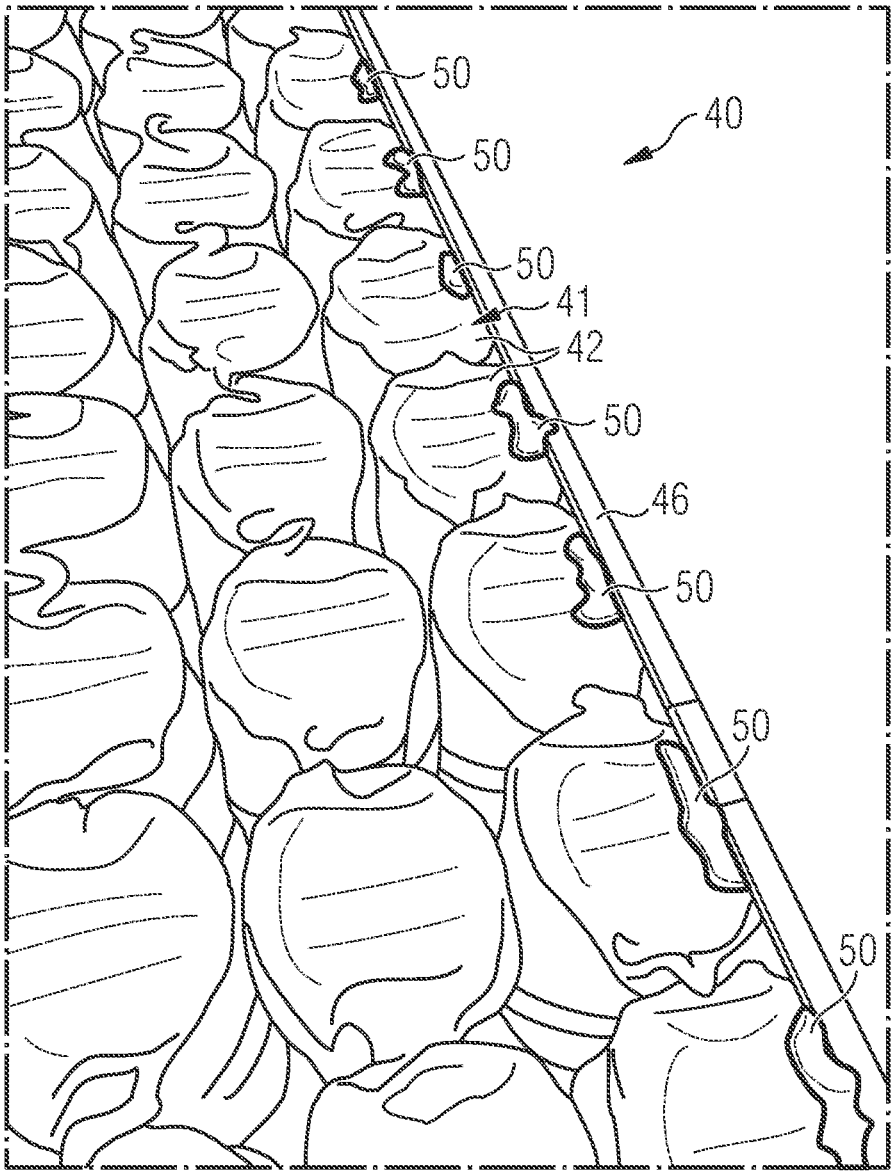
FIGS. 11-13 show schematic perspective views of a pocket spring core according to further embodiments.

FIG. 11 shows a further example of gluing a frame element 46 to the pockets 42 of a pocket spring core 40. The frame element 46 is glued to a flat, disk shaped base of the cylindrical or barrel shape of the pocketed spring elements 41.

The frame element 46 may be glued to the pocket 42, which may be made of nonwoven material, by adding a defined glue quantity and extent of the glue 50 to create adhesion between the material of the pocket 42 and the flat frame element 46. A large variety of glue patterns may be used. For example a predefined glue quantity and extent of the glue 50 may be added to each single pocket 42 along the frame element 46. In another example, a predefined glue quantity and extent of the glue 50 may be added to every second pocket 42 along the frame element 46. In general, a predefined glue quantity and extent of the glue 50 may be added to the pockets 42 along the frame element 46 as needed to obtain a sufficient adhesion.

Although not shown in FIG. 11, in further embodiments, the frame element 46 may also be glued to the pockets 42 by creating an unbroken, uniform glue line on the disk shaped bases of the pockets 42 along the frame element 46. Preferably, the uniform glue line on the disk shaped bases is formed along a diameter of each of the disk shaped base of each pocket 42 such that the continuous unbroken blue line can be formed. The frame element 46 may be placed in this glue line.

Figure 12:
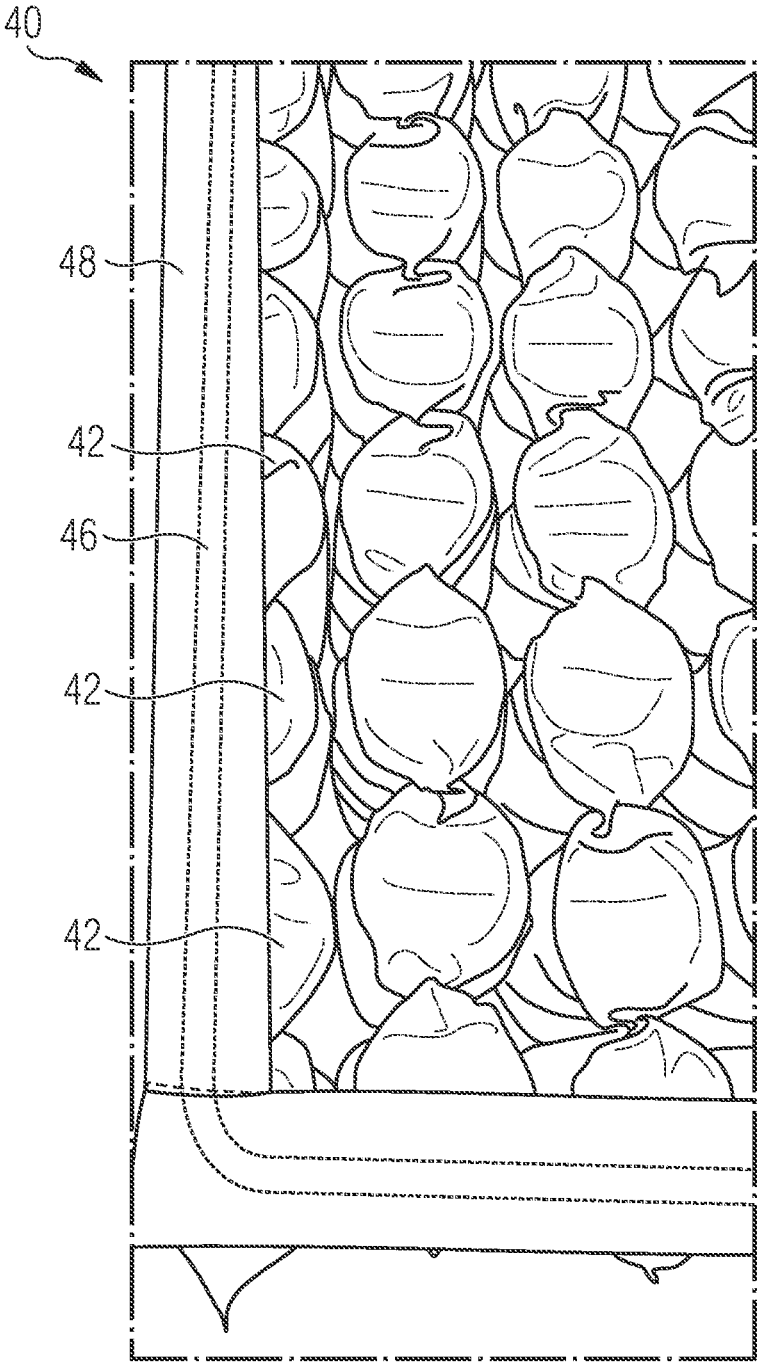

As shown in FIG. 12, a cover sheet 48, which may be made of nonwoven material, may be placed on the frame element 46, for example after a while gluing the frame element 46 to the pockets 42. The cover sheet 48 may extend along the frame element 46 and may have a width which is larger than the width of the frame element 46. The width of the cover sheet 48 may be sufficient to cover the frame element 46 and an expected excess of glue at each side of the frame element 46. The width of the cover sheet 48 may be in a range of 5 to 15 cm, for example, the width of the cover sheet 48 may be 10 cm. A length of the cover sheet 48 may correspond essentially to a length of the part of the frame element 46 on which it is placed. For example, a length of the cover sheet 48 may be in a range of 60 cm to 220 cm. By adding such a narrow elongate cover sheet 48, unintended attachment to for example roll back paper in the following process of roll packaging the pocket spring core 40 may be avoided. Furthermore, unintended attachment to other pocket spring core units from glue residues outside the frame when stacking the several pocket spring core units after frame gluing may be avoided.

Figure 13:
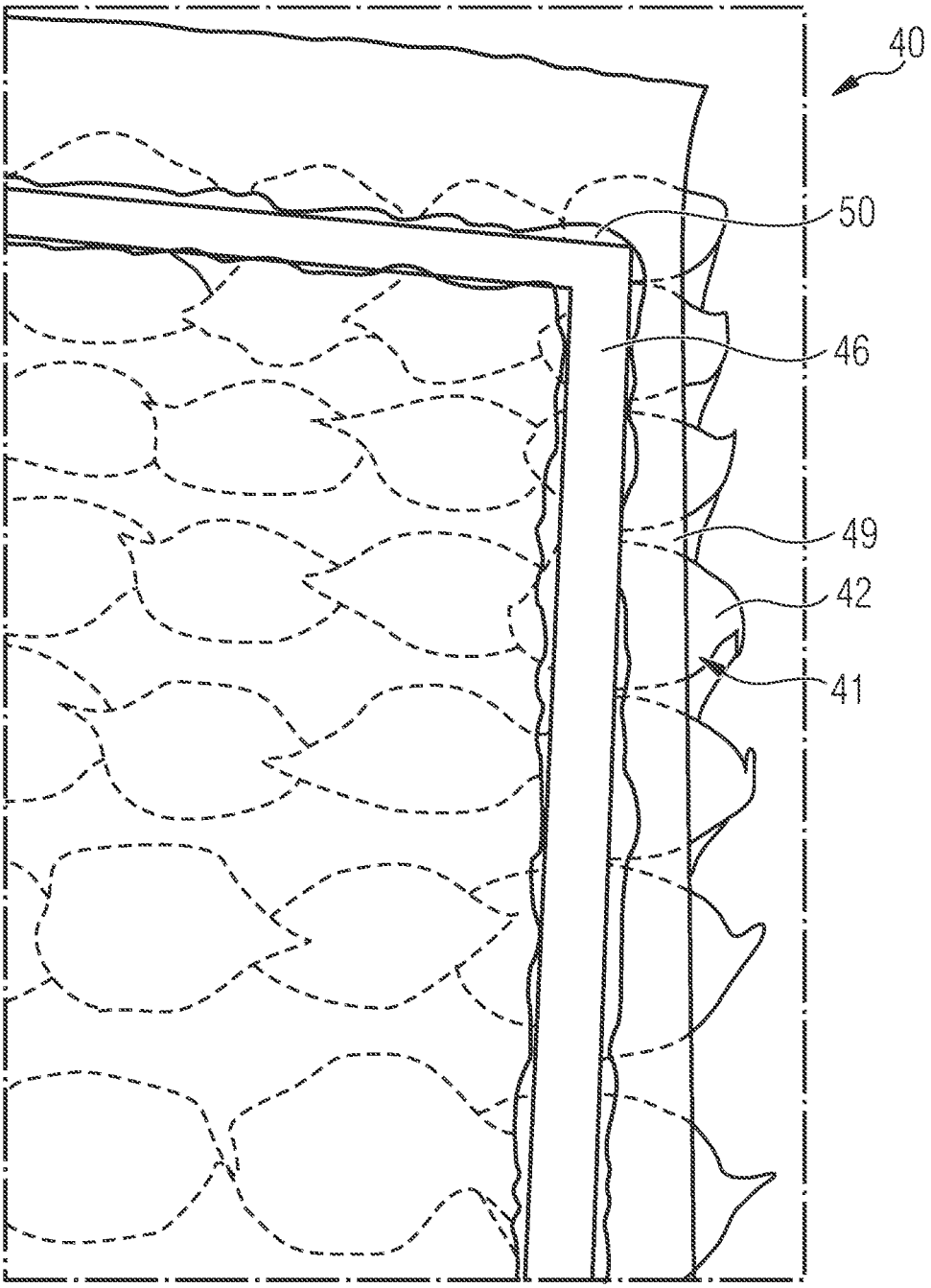

FIG. 13 shows a further example of gluing a frame element 46 to a plurality of pocketed spring elements 41. A sheet layer 49, which may be made of nonwoven material, is glued to the disk shaped bases of at least some of the plurality of pocketed spring elements 41. In particular, one surface of the sheet layer 49 may be glued to the disk shaped base part of the pocket 42 of at least some of the plurality of pocketed spring elements 41. For example, the sheet layer 49 may be glued to all pocketed spring elements 41 which are arranged at the circumference of the arrangement of the plurality of pocketed spring elements of the pocket spring core 40. In another example, the sheet layer 49 may be glued to all pocketed spring elements 41 of the spring core 40. In the latter case, the sheet layer may have a size which corresponds to the size of the pocket spring core, for example, the sheet layer may have the width in a range of 70 to 160 cm and a length in a range of 190 to 220 cm. The other opposing surface of the sheet layer 49, which does not face the pockets 42 to which the sheet layer 49 is glued, is provided with glue 50 for attaching the frame element 46 onto the sheet layer 49. For example, an unbroken, uniform glue line of glue 50 may be provided on the sheet layer 49 such that the frame element 46 is continuously glued to the sheet layer 49. In another example, the frame element 46 may be glued to the sheet layer 49 at distinct contact points only, i.e. the glue is applied in a broken manner. As described above in connection with FIG. 12, an additional cover sheet 48 may be provided on the frame element 46 for covering the frame element 46 and an expected excess of glue 50.

The invention claimed is:

1. A pocket spring core, comprising:

a plurality of pocketed spring elements, each of the plurality of pocketed spring elements being formed of a pocket and at least one coil spring enclosed by the pocket, and a frame element made of metal or plastic enclosing an arrangement of at least a subset of the plurality of pocketed spring elements along a circumference of the arrangement, a sheet layer arranged between the frame element and at least some of the plurality of pocketed spring elements, wherein one surface of the sheet layer is glued to disk shaped bases of the at least some of the plurality of pocketed spring elements and another surface of the sheet layer opposing the one surface of the sheet layer is glued to the frame element, an additional cover sheet on the frame element for covering the frame element and an expected excess of glue, wherein the additional cover sheet is a narrow and elongate sheet and wherein the sheet layer is glued to the disk-shaped bases of the at least some of the plurality of pocketed spring elements and to the frame element using an adhesive selected from a group comprising:

a hot melt adhesive, a polyurethane adhesive, and an epoxy lime adhesive.

2. The pocket spring core of claim 1 wherein the hot melt adhesive is based on at least one of a group comprising:

polymer components including polyolefins, linear low density polyethylene, ethylene based semi-crystalline polymers, isotactic polypropylene, propylene based polymers, styrene block copolymers, ethylene ethyl acrylate copolymers, polyamides, polyesters, and polyurethane reactive adhesives.

3. The pocket spring core of claim 1, wherein the polyurethane adhesive comprises a polyurethane adhesion based on isocyanate and polyolen.

4. The pocket spring core of claim 1, wherein the epoxy lime adhesive comprises a two-component epoxy glue.

5. The pocket spring core of claim 1, wherein each pocket of the plurality of pocketed spring elements has a cylindrical shape.

6. The pocket spring core of claim 1, wherein each pocket of the several pockets is made by at least one of spunbonding and needlepunching.

7. The pocket spring core of claim 1, wherein the cover sheet is made of a nonwoven material.

8. The pocket spring core of claim 1, wherein the frame element has a cross section comprising at least one of a group comprising:

a quadratic cross section, a rectangular cross section, a triangular cross section, a trapezium cross section, a polygonal cross section, a circular cross section, an ellipse cross section, and an oval cross section.

9. The pocket spring core of claim 1, wherein the additional cover sheet is arranged along the frame element and has a width larger than a width of the frame element.

10. The pocket spring core of claim 1, wherein each pocket of the plurality of pocketed spring elements has a cylindrical shape, wherein the sheet layer is glued to a disk-shaped region of each pocket of the plurality of pocketed spring elements.

11. The pocket spring core of claim 10, wherein the frame element enclosing the arrangement of the plurality of pocketed spring elements along a circumference of the arrangement is glued to the sheet layer with an unbroken glue line.

12. The pocket spring core of claim 10, wherein the frame element is glued to the sheet layer at distinct contact points only.

13. A bedding or seating product, wherein the bedding or seating product comprises the pocket spring core according to claim 1.

14. A method of manufacturing a pocket spring core, the method comprising:

providing a plurality of pocketed spring elements, each of the plurality of the pocketed spring elements being formed of a pocket and at least one coil spring enclosed by the pocket, positioning a metal or plastic frame element such that the frame element encloses an arrangement of at least a subset of the plurality of pocketed spring elements along a circumference of the arrangement;

arranging a sheet layer between the frame element and at least some of the plurality of pocketed spring elements, wherein one surface of the sheet layer is glued to disk shaped bases of the at least some of the plurality of pocketed spring elements and another surface of the sheet layer opposing the one surface of the sheet layer is glued to the frame element, and gluing the frame element to the at least some of the plurality of pocketed spring elements using an adhesive selected from a group comprising:

a hot melt adhesive, a polyurethane adhesive, and an epoxy lime adhesive, and gluing an additional cover sheet on the frame element for covering the frame element and an expected excess of glue, the additional cover sheet being a narrow and elongate sheet.

15. The method of claim 14, wherein the method is carried out to manufacture the pocket spring core.

16. The method of claim 14, wherein at least the steps of positioning and gluing are performed automatically by a manufacturing machine.

* * * * *